United States Patent [19]

Macfarlane

[11] 4,319,538

[45] Mar. 16, 1982

[54] KICKUP RUDDER ASSEMBLY HAVING ROLLER DETENT

[75] Inventor: Richard O. Macfarlane, Mosman Fields, Australia

[73] Assignee: Windrush Nominees Pty. Ltd., O'Conner, Australia

[21] Appl. No.: 127,974

[22] Filed: Mar. 7, 1980

[51] Int. Cl.[3] ..... B63H 25/06

[52] U.S. Cl. ..... 114/165; 114/162

[58] Field of Search ..... 114/162, 163, 164, 165

[56] References Cited

U.S. PATENT DOCUMENTS

| | | | |
|---|---|---|---|
| 439,573 | 10/1890 | Baxter | 114/165 |
| 3,731,645 | 5/1973 | Pearce | 114/162 |
| 3,921,561 | 10/1975 | Arce | 114/165 |
| 3,952,682 | 4/1976 | Ingham | 114/162 |
| 4,046,093 | 9/1977 | Prindle | 114/165 |

FOREIGN PATENT DOCUMENTS

| | | | |
|---|---|---|---|
| 218997 | 6/1925 | United Kingdom | 114/163 |

*Primary Examiner*—Trygve M. Blix
*Assistant Examiner*—John C. Paul
*Attorney, Agent, or Firm*—Harness, Dickey & Pierce

[57] ABSTRACT

A rudder assembly for a sailing craft comprising a housing adapted to be pivotally mounted on the stern of the craft for rotation about a substantially vertical axis, and a rudder pivotally mounted in said housing for rotation about a substantially horizontal transverse axis, means for holding the rudder in a downwardly projecting position and a rearwardly projecting position, said means comprising a roller urged into engagement with one of a plurality of indentations provided on said rudder.

8 Claims, 5 Drawing Figures

KICKUP RUDDER ASSEMBLY HAVING ROLLER DETENT

This invention relates to a rudder assembly for a sailing craft and in particular to a rudder assembly for use on catamarans.

Throughout Australia, on both the surrounding oceans and on inland waterways has appeared thousands of sailing craft of the catamaran type. Being designed without a centreboard, light enough to be carried on the roof of a motor vehicle, and yet strong enough to perform admirably in rough seas has led to a tremendous increase in the number of yachtsmen. Coupled with the increase in the number of boats, has been the increase in clubs, national events and the continual pursuit of developing a faster boat. In attempts to produce a faster and better boat many alternative forms of rigging has been developed. Some equipment being suited for sailing on flat water whilst other equipment is at its best in rough ocean or choppy seas. One particular component that has come under a lot of criticism has been the style of rudder and rudder system utilised. A shallow rudder allows the owner to experience the thrill of "surfing" a wave to the beach and at the same time provides reasonable control. A deeper style of rudder gives better control but runs into problems when surfing or sailing in shallow waters. It is with these problems in mind that has led to the development of the current invention.

In one form the invention resides in a rudder assembly for a sailing craft comprising a housing adapted to be pivotally mounted on the stern of the craft for rotation about a substantially vertical axis, and a rudder pivotally mounted in said housing for rotation about a substantially horizontal transverse axis, means for holding the rudder in a downwardly projecting position and a rearwardly projecting position, said means comprising a roller urged into engagement with one of a plurality of indentations provided on said rudder.

In another form the invention resides in a rudder assembly for a sailing craft comprising a housing adapted to be pivotally mounted on the stern of the craft for rotation about a substantially vertical axis, and a rudder pivotally mounted in said housing for rotation about a substantially horizontal transverse axis, means for holding the rudder in a downwardly projecting position and a rearwardly projecting position, the pivotal mounting of the rudder in the housing being such that if a forwardly directed force of sufficient strength to damage the rudder is applied to the rudder the rudder will disengage from said pivotal mounting.

Preferably the rudder may also be held in an intermediate position between the downwardly and rearwardly projecting positions.

The invention will be better understood by reference to the following description of one specific embodiment as shown in the accompanying drawings wherein.

Figure 1:
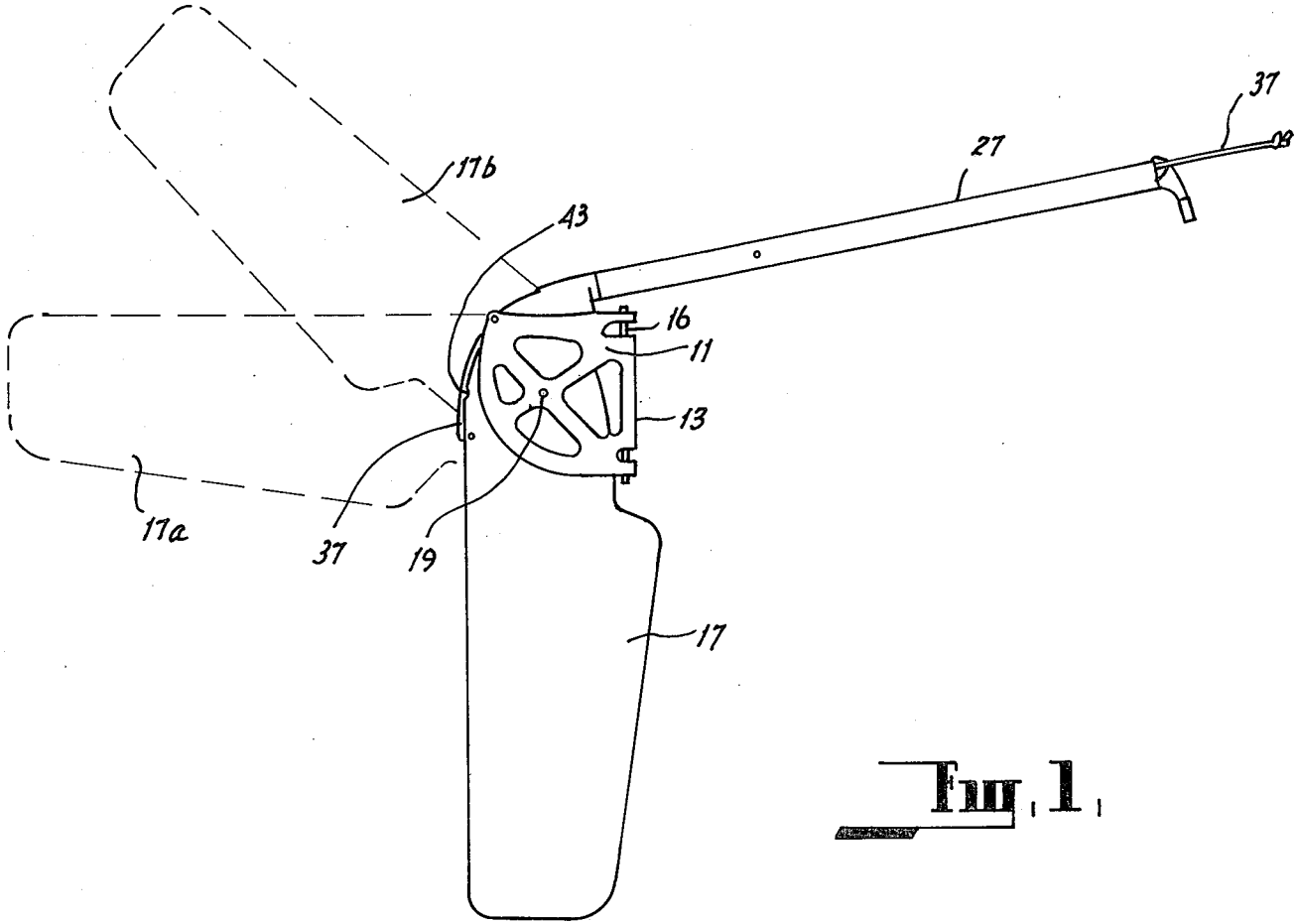
FIG. 1 is a side elevational view of the rudder assembly with the rudder in the downwardly projecting position.

In the embodiment shown in the drawings a rudder assembly for a sailing craft is constructed comprising a housing 11 adapted to be pivotally mounted on the stern of the craft for rotation about a substantially vertical axis.

Figure 2:
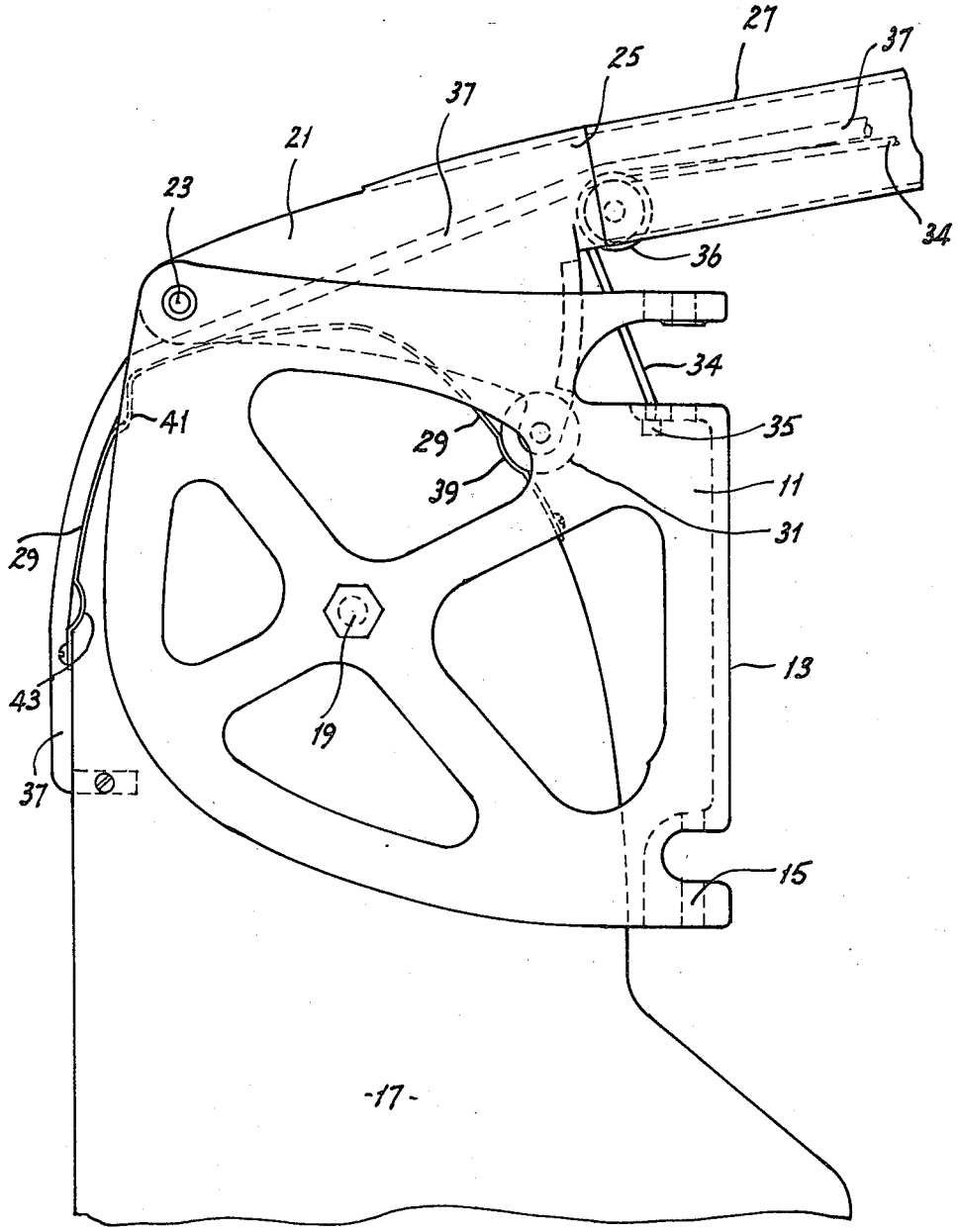
FIG. 2 is a part sectional side elevation of the rudder mounting within the housing.
Figure 3:
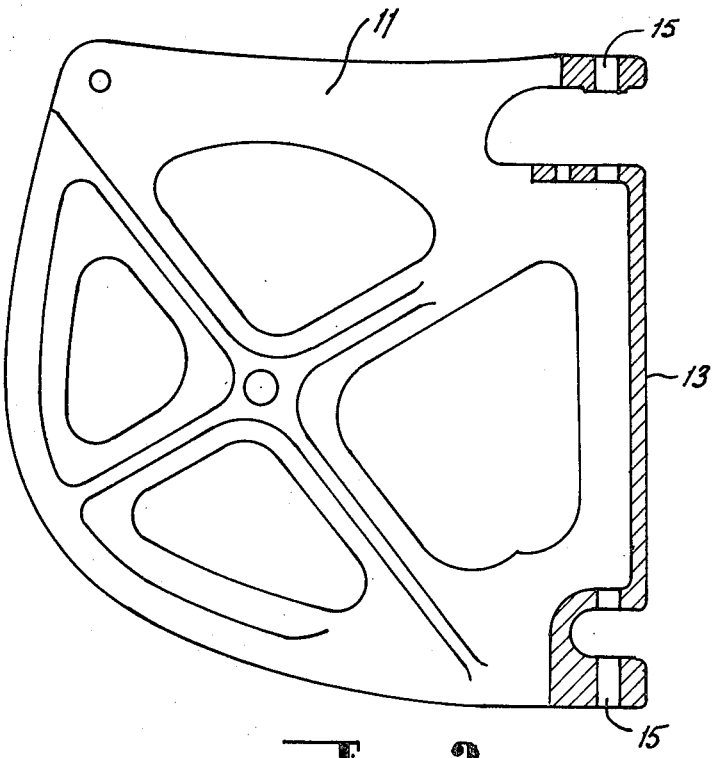
FIG. 3 is a sectional side elevation of the housing.
Figure 4:
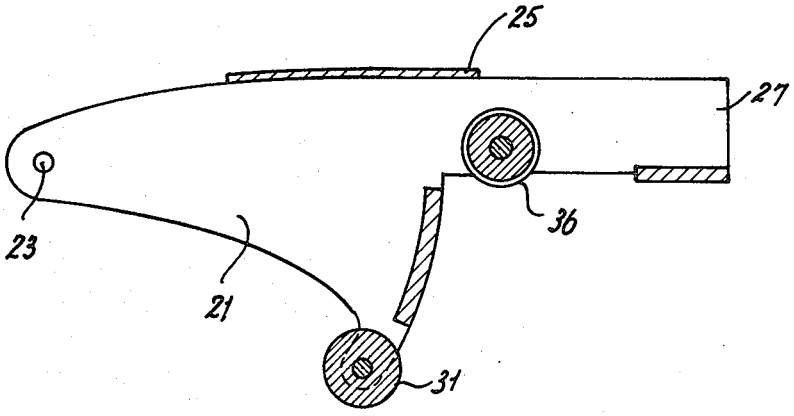
FIG. 4 is a sectional side elevation of the member connecting tiller arm to rudder assembly.
Figure 5:
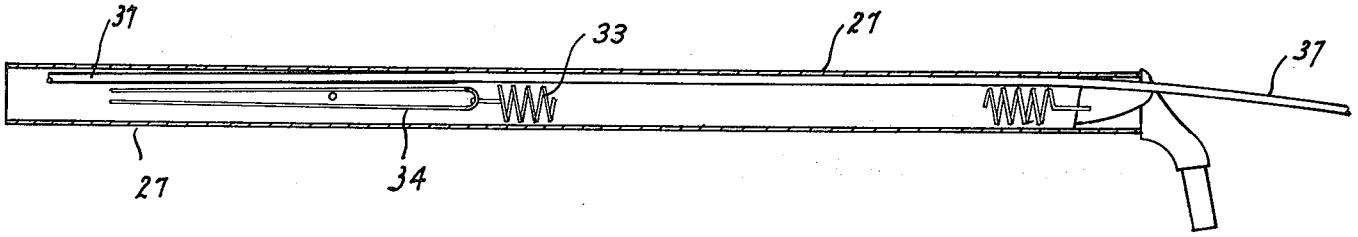
FIG. 5 is a sectional view of the tiller arm.

As shown in FIGS. 2 and 3 of the drawings the forward face 13 of the housing 11 may contain a passage 15 through which may be passed a pin 16 or similar device to secure the housing to the stern of the craft. A rudder 17 is pivotally mounted in the housing 11 on pin 19. The rudder 17 being rotatable about a substantially horizontal transverse axis. A means is provided to hold the rudder 17 in a rearwardly or downwardly projecting position. The means comprising a small housing 21 (shown in FIG. 4) pivotally mounted at one end 23 to the housing 11 whilst its other extremity 25 is connected to the tiller arm 27.

Projecting downwardly from the housing 21 to engage the upper edge 29 of the rudder 17 is a bush or roller 31. A spring 33 or similarly suitable tension device is housed within the tiller arm 27. One end of spring 33 being secured to a wire 34 which passes over roller 36 provided within housing 21 and is secured 35 to the housing 11, whilst the other end of the spring 33 is secured within the tiller arm 27. A cord 37 passes through the tiller arm 27 and has one end connected to the rudder 17 and its other end accessable to the skipper of the craft. The upper edge 29 of the rudder 17 is provided with a series of concave depressions 39, 41, 43 to mate with roller 31 on the raising or lowering of the rudder 17.

The shape of the rudder head and the location of each of the concave depressions 39 to the pivot pin 19 is such that on raising or moving the rudder 17 from a downwardly projecting position to a rearwardly projecting position, the radius increases. On lowering the rudder to a downwardly projecting position, the distance of the roller 31 from pin 19 is reduced or in other words the radius of the rudder head decreases.

In operation, the rudder has a restraining force to maintain it in a downwardly projecting position. As the rudder pivots rearwardly on pin 19, the greater or increasing radius provided on the rudder head causes the roller 31 to rise, pivot on point 23 and thereby tension spring 33 which is secured to the housing 11 via wire 34. Thus contact with an underwater obstruction will cause the blade 17 to move rearwardly and increase the tension on spring 33 which, when the obstruction is removed or passed will assist to return the rudder to its normal operating position. If it is required to raise the rudder by hand the cord 37 is pulled by the skipper and the roller 31 will travel over the head of the rudder blade until it engages in depression 39, 41 or 43, thereby maintaining the rudder in position 17, 17*a* or 17*b* respectively. As roller 31 moves over surface 29 the roller, as previously described, lifts and consequently so does the tiller arm 27 which is secured to housing 21. In order to lower the rudder the tiller arm 27 is lifted slightly to disengage roller 31 from the engaged depression 41 or 43; by holding the tiller arm 27 the rate of descent can be controlled until the selected new rudder position has been attained. The downward movement of the rudder being controlled by spring 33 and the fact that roller 31 travels from a larger to a smaller rudder head radius.

In a second embodiment of the invention the rudder 17 may be provided with means which enables the rudder to be released from pin 19 when either an excessive forwardly or rearwardly directed force is applied to the rudder 17. Such means may consist of a groove or channel running from the edge of the rudder to the pivotal mounting.

Whilst the invention has been described with reference to one specific embodiment, it is not limited thereto and numerous alterations may be made without departing from the scope of the claims.

I claim:

1. A rudder assembly for a sailing craft comprising a housing adapted to be pivotally mounted on the stern of the craft for rotation about a substantially vertical axis, and a rudder pivotally mounted in said housing for rotation about a substantially horizontal transverse axis, said rudder being pivotal about said horizontal axis between a downwardly projecting position and a rearwardly projecting position, means for holding the rudder in either of said positions, said means comprising first and second indentations formed in said rudder and corresponding to the respective of said positions, said first indentation lying at a different distance from said horizontal axis than said second indentation, and a roller urged into engagement with a selected one of said indentations.

2. A rudder assembly for a sailing craft as claimed in claim 1 wherein the holding means permits said rudder also to be held in a vertically upwardly projecting position.

3. A rudder assembly for a sailing craft as claimed in claim 2 wherein a cord is connected to said rudder and passes through a tiller arm connected to said rudder housing, said cord being operated by an occupant of the sailing craft to move said rudder from a downwardly projecting position to an upwardly projecting position or anywhere therebetween.

4. A rudder assembly for a sailing craft as claimed in claim 1 wherein said roller is urged into engagement with one of a plurality of indentations provided on said rudder by a wire member passing through said means and having one end secured to the said housing, the other end of said wire member being linked to a tensioning device housed within a tiller arm connected to said rudder assembly.

5. A rudder assembly for a sailing craft as claimed in claim 4 wherein said tensioning means comprises a spring.

6. A rudder assembly as set forth in claim 1 wherein the rudder is further pivotal about the horizontal axis to a vertically upwardly projecting position and further including a third indentation formed in said rudder and engageable with the roller for holding said rudder in said vertically upwardly projecting position, said third indentation being spaced a different distance from said horizontal axis from the first and second indentations.

7. A rudder assembly as set forth in claim 6 wherein the distance of the first indentation from the horizontal axis is less than the distance to the remaining indentations and the second indentation is spaced from said horizontal axis a distance less than the third indentation whereby a progressively increasing resistance is provided to pivotally move said rudder from its downwardly projecting position to its upwardly projecting position.

8. A rudder assembly as set forth in claim 7 wherein the roller is carried by means operatively connected to said tiller and pivotally supported by the housing about an axis parallel to and offset from the horizontal axis of said rudder.

* * * * *